US005375500A

United States Patent [19]

Halpin

[11] Patent Number: 5,375,500

[45] Date of Patent: Dec. 27, 1994

[54] TUNABLE DRUM

[76] Inventor: Alfred J. Halpin, 2777 J Innes Rd., Gloucester, Ontario, Canada, K1B 3J7

[21] Appl. No.: 141,542

[22] Filed: Oct. 27, 1993

[51] Int. Cl.[5] ..... G10D 13/02

[52] U.S. Cl. ..... 84/413; 84/411 R

[58] Field of Search ..... 84/411 R, 412, 413, 84/419, 420

[56] References Cited

U.S. PATENT DOCUMENTS

| | | | |
|---|---|---|---|
| 1,407,108 | 2/1922 | Williams | 84/413 |
| 2,485,985 | 10/1949 | Perry | 84/413 |
| 4,168,646 | 9/1979 | May | 84/413 |
| 4,714,002 | 12/1987 | Cleland | 84/413 |

*Primary Examiner*—Michael L. Gellner
*Assistant Examiner*—Cassandra C. Spyrou
*Attorney, Agent, or Firm*—Adrian Zahl

[57] ABSTRACT

A tunable drum is provided, having drum body comprised of first and second parts adjustable relative to each other such that the first part may be moved either towards or outwardly away from the second part. The skin of the drum is fastened to the second part of the drum body and by adjusting the position of the first part relative to the second part, the tension of said skin across the body may be varied, and the pitch or the drum varied.

The first part of the body may comprise an upper rim of the body, with the rim being moveable either upwardly or radially outwardly relative to the second part of the body. In the latter case, the rim is provided with an expansion joint to permit the outward expansion of the rim. The rim is adjusted by means of an array of threaded rotatable bolts extending through the body to engage the rim and push it outwardly when the bolts are rotated.

6 Claims, 2 Drawing Sheets

TUNABLE DRUM

FIELD OF THE INVENTION

The present invention relates to a musical drum having means for adjusting the tension on the skin, for the tuning of the drum.

BACKGROUND OF THE INVENTION

Musical drums require often periodic tuning, both to compensate for expansion and contraction of the skin or head and to change to change the pitch of the drum to accommodate musical needs. The skin typically expands and contracts in response to climactic changes and aging of the skin. The use of natural hides in drums, for example goatskin, provides a desirable musical quality to a drum, but typically results in significant expansion and contraction of the skin, with attendant changes in pitch.

Means have been developed in the past to adjust the tension on the skins of various types of drums. Typically, these have comprised various arrangements of cords and turnbuckles or other tensioning devices mounted to the outside of the drum body, to pull the skin downwardly over the body of the drum. These solutions require the use of a relatively large number of tensioning devices, particularly if the drum has a large diameter, making tuning the drum time-consuming and complex. As well, where it is desired to provide a smooth exterior to the body of the drum, for example, in a hand-held drum, these solutions are not useable. A hand-held drum, such as a traditional Irish bodhran, is generally grasped by the body of the drum, and the presence of externally-mounted tensioning devices would hinder the musician's ability to handle the drum. As well, it may be desirable for sake of appearance to provide a smooth, clean exterior of the drum.

Accordingly, it is desirable to provide a drum wherein the tuning means for the skin is relatively simple in operation and is positioned within the body of the drum, so as to avoid the use of external tensioning devices.

OBJECTS OF THE INVENTION

It is an object of the invention to provide a drum having a means to adjust the tension on the skin, with the means at least partly housed within the drum body or within the interior of the drum body. It is a further object to provide a relatively simple means for the user to adjust the tension on the skin.

SUMMARY OF THE INVENTION

The present invention is a tunable drum comprised of a hollow cylindrical body having an open upper end, a skin stretched across the open upper end, and a rim encircling the body. The rim has an interior surface facing the body and an exterior surface facing away from the body. The skin extends over the exterior surface of the rim and is fastened to the body below the rim. The skin thus wraps over the upper margin of the drum to present a flush appearance that is both aesthetically pleasing and easy to grip when the drum is used as a hand drum. The drum is tuned by way of skin tensioning means that move the rim vertically relative to the body, with upward movement of the rim increasing the tension of the skin. The skin tensioning means may comprise an array of vertically-oriented bolts recessed into the drum body, that when tightened push the rim upwardly. In an alternative embodiment of the invention, the rim expands outwardly to increase tension on the skin. It is also desirable for the rim to elevate the skin above the upper edge of the drum body, in order to improve the tone of the drum.

The directional references employed herein refer to a drum held in the conventional upright position, with the skin of the drum held generally horizontally and comprising the upper face of the drum.

DETAILED DESCRIPTION OF THE PREFERRED EMBODIMENT

Figure 1:
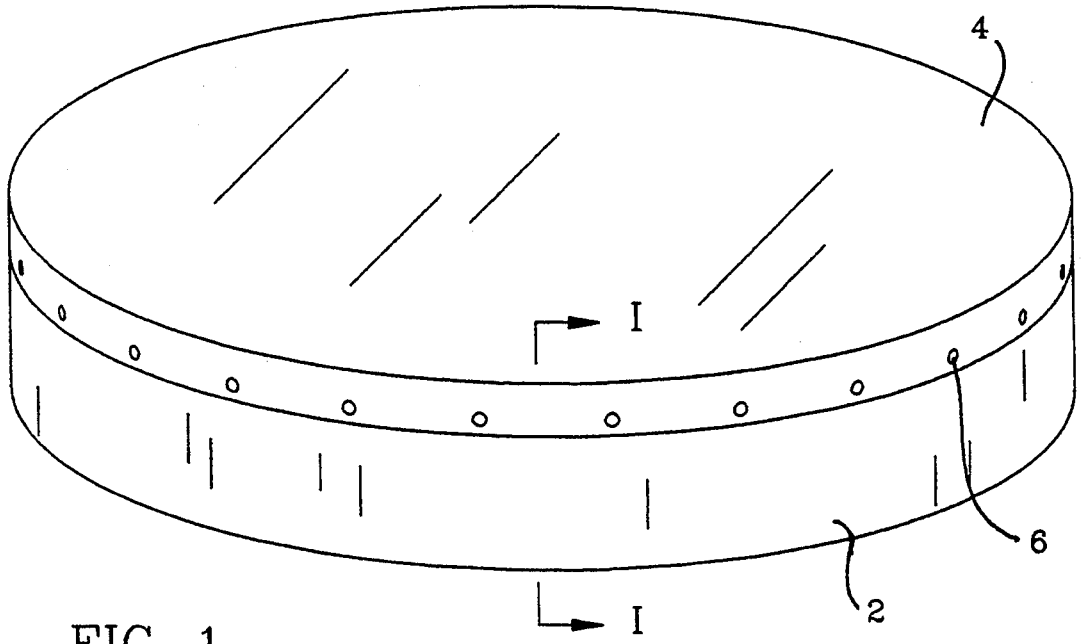
FIG. 1 is a perspective view of a drum according to the present invention.

A drum according to the present invention, as seen in FIG. 1, comprises a hollow cylindrical body 2, having open upper and lower ends, and a skin 4 stretched over the top of the body. The body may have virtually any size or shape, but a typical drum has a generally cylindrical body as shown in FIG. 1, and is fabricated from wood. The skin covers the upper end of the body and is stretched over the sidewall thereof. An array of small nails or tacks 6 engages the skin to the sidewall of the body.

Figure 2:
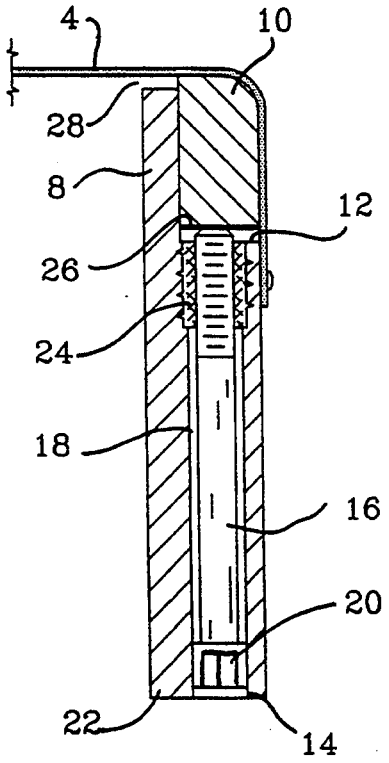
FIG. 2 is a sectional view, along line a—a of FIG. 1, of a first embodiment of the invention.

Referring to FIG. 2, the upper margin of the body 2 comprises a lip 8 and a rim 10 slideably engaged thereto. The lip 8 is inwardly recessed at the perimeter of the body at shoulder 12. The rim 10 is held within the inward recess by the tension of the skin 4 stretched over the top of the rim. The position of the rim 10 may be adjusted vertically relative to the shoulder 12, by tensioning means 14 positioned at regular intervals around the body. A typical 14 inch drum will be provided with five or six tensioning means. Each tensioning means comprises a bolt 16 rotatably engaged within a bore 18 extending upwardly through the body 2. The head of the bolt 20 is exposed at the lower edge 22 of the body, and is provided with engagement means to allow the bolt to be turned by an allen key wrench or the like. The upper end of the bolt is threaded into a nut 24 recessed into the upper margin of the shoulder 12. The nut may be externally threaded, to provide a means for engaging the nut within the body of the drum. It will be seen that the nut may be positioned anywhere within the body along the length of the bolt 20. The threading on the bolt 20 is limited to prevent overtightening of the skin.

The upper end of the bolt extends outwardly above the shoulder 12, and engages the rim 10. The rim 10 may be provided with a contact plate 26 glued or otherwise fastened to its lower margin, of steel or other hard material, to prevent the bolt 20 from damaging the rim. Rotation of the bolt raises or lowers the rim 10, resulting in a tensioning or loosening of the skin and a consequent change of its pitch.

The rim 10 may be provided with any desired cross-sectional profile. For example, a finger-held drum may require the exposed corner of the rim to be bevelled. For other uses, a relatively small-radius rounding of the rim may be sufficient.

The elevation of the rim above the level of the lip 8 allows the skin to be lifted off the lip resulting in a gap 28 between the lower face of the skin and the upper face of the lip, as shown in FIG. 2. This can enhance desirable musical properties of the drum by reducing the buzzing sound caused by contact between the skin and the lip.

Figure 3:
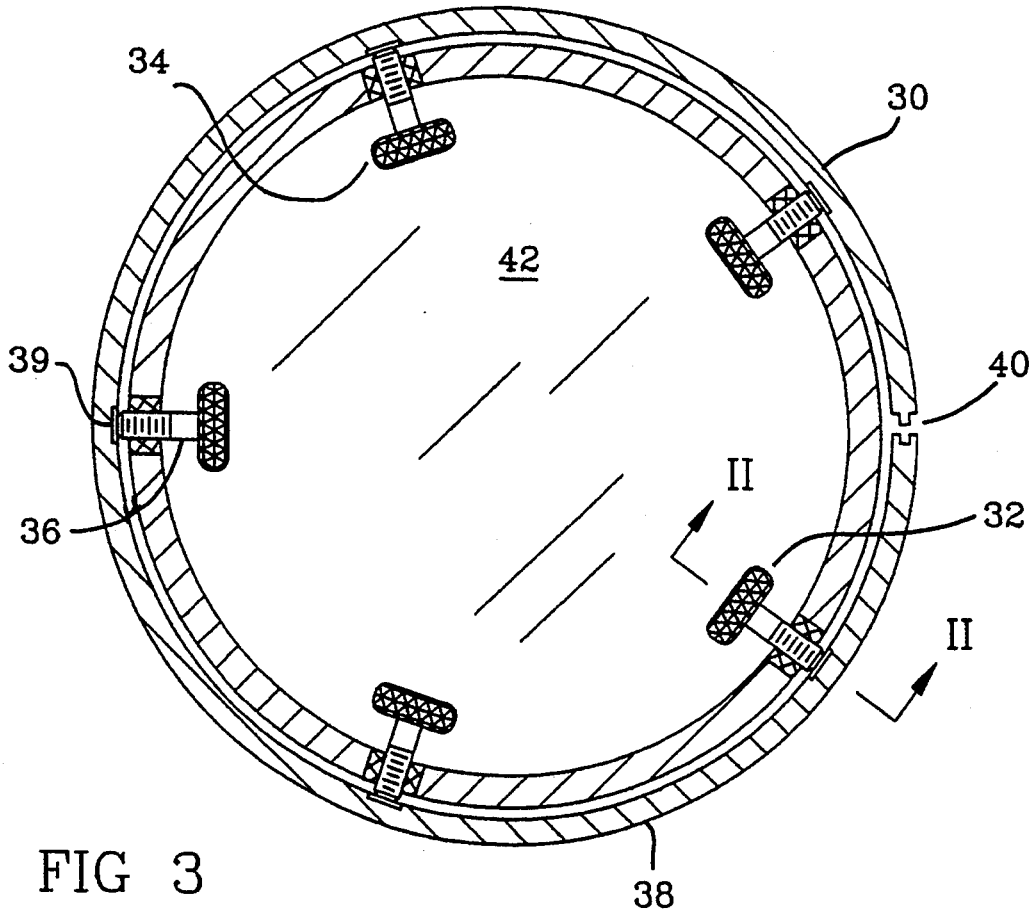
FIG. 3 is a top view of a drum body with the skin removed, showing a second embodiment of the invention.
Figure 4:
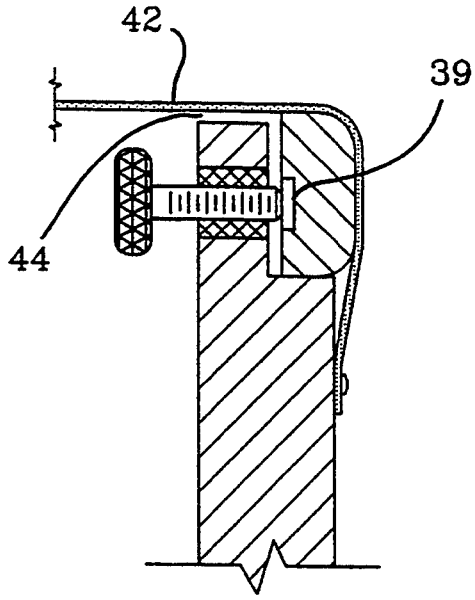
FIG. 4 is an sectional view along line b—b of FIG. 3.

A second embodiment of the drum is shown at FIGS. 3 and 4. In this embodiment, the rim is expandable outwardly, instead of upwardly, relative to the drum body. The drum body 30 is provided with an array of regularly spaced hand-turnable bolts 32, the heads 34 of which extend into the interior of the drum and the bodies 36 of which extend through the body of the drum adjacent the upper lip thereof. The bolts contact a rim 38 encircling the upper margin of the drum. The rim is provided with contact plates 39 glued or otherwise fastened to the inside face of the rim adjacent the contact point of each of the bolts, to prevent the bolts from damaging the rim. It will be seen that the rim 38 need not be positioned adjacent the upper lip of the drum, provided that sufficient space exists for the attachment of the skin on the drum body below the level of the rim. In general, it is preferable to position the rim adjacent the upper edge of the body. The rim 38 is provided with an expansion joint 40 that allows it to radially expand or contract as the bolts are tightened or loosened. The rim 38 is held in position about the drum by the tension of the skin 42 stretched over the rim and extending partway down the sidewall of the body. The rim is positioned to provide a gap 44 between the lower face of the skin and the upper edge of the body.

It will be seen that various alternative arrangements could be provided to incorporate the tuning means described herein into a drum. Thus, any means by which a portion of the body of a drum is extended relative to another part of the body, in order to stretch or loosen the skin positioned over the first part, will incorporate the present invention.

Although the present invention has been described by way of preferred embodiments thereof, it will be seen by those skilled in the art that numerous variations may be made thereto without departing from the spirit and scope of the invention, as set out in the appended claims.

I claim:

1. A drum comprised of a hollow cylindrical body having an open upper end, a skin stretched across said open upper end, and a rim encircling said body, said rim having an interior surface facing the body and an exterior surface facing away from the body, wherein said skin extends over the exterior surface of said rim and is fastened to said body below said rim, and wherein there is provided tensioning means to move said rim vertically relative to said body, wherein movement of said rim upwardly increases the tension of said skin across said open upper end.

2. A drum as claimed in claim 1, wherein said rim is positioned adjacent the open upper end of said body, said rim having a lip at its upper edge that extends above the upper end of said body, wherein said skin is stretched over the top of said lip and is elevated off the upper end of said body.

3. A drum as claimed in claim 1 wherein said tensioning means comprises an array of rotatable threaded bolts extending through said body, the ends of which engage said rim to adjust the position of the rim when the bolts are rotated.

4. A drum as claimed in claim 1 wherein said rim is positioned within a recess extending around the upper edge of the body.

5. A drum comprised of a hollow cylindrical body having an open upper end, a skin stretched across said open upper end, and a rim encircling said body, said rim having an interior surface facing the body and an exterior surface facing away from the body, wherein said skin extends over the top of said rim and is fastened to said body below said rim, and wherein there is provided tensioning means to move said rim radially inward or outward relative to said body, wherein movement of said rim radially outward increases the tension of said skin across said open upper end.

6. A drum as claimed in claim 5 wherein said rim is expandable outwardly by means of an array of rotatable threaded bolts extending through said body and engaging said band.

* * * * *